US007712984B2

(12) United States Patent
Block et al.

(10) Patent No.: US 7,712,984 B2
(45) Date of Patent: May 11, 2010

(54) HYBRID PRINTER

(75) Inventors: David Block, El Cerrito, CA (US); James Craig, Newtown, CT (US)

(73) Assignee: Sanford L.P., Oak Brook, IL (US)

( * ) Notice: Subject to any disclaimer, the term of this patent is extended or adjusted under 35 U.S.C. 154(b) by 1021 days.

(21) Appl. No.: 11/246,289

(22) Filed: Oct. 11, 2005

(65) Prior Publication Data

US 2006/0092193 A1 May 4, 2006

Related U.S. Application Data

(60) Provisional application No. 60/620,685, filed on Oct. 22, 2004.

(51) Int. Cl.
*B41J 3/54* (2006.01)
*B41J 11/48* (2006.01)

(52) U.S. Cl. ..... 400/149; 400/605

(58) Field of Classification Search ..... 347/111, 347/112, 113, 114, 115, 138, 139, 152, 153; *G03G 15/00; B41J 11/48*

See application file for complete search history.

(56) References Cited

U.S. PATENT DOCUMENTS

| | | | | |
|---|---|---|---|---|
| 4,788,558 | A * | 11/1988 | Caldwell et al. | 347/215 |
| 5,117,753 | A * | 6/1992 | Mamberer | 101/225 |
| 5,248,207 | A * | 9/1993 | Yamamoto et al. | 400/120.16 |
| 5,546,116 | A * | 8/1996 | Nardone et al. | 347/218 |
| 5,913,623 | A | 6/1999 | Yamaguchi et al. | |
| 5,938,351 | A * | 8/1999 | Hamisch et al. | 400/234 |
| 6,014,159 | A | 1/2000 | Yamaguchi et al. | |
| 6,249,301 | B1 * | 6/2001 | Kawamura et al. | 347/218 |
| 6,267,520 | B1 * | 7/2001 | Unno et al. | 400/663 |
| 6,341,906 | B2 * | 1/2002 | Kobayashi et al. | 400/207 |
| 6,557,465 | B2 * | 5/2003 | Baum | 101/174 |
| 6,607,316 | B1 * | 8/2003 | Petteruti et al. | 400/82 |
| 6,634,292 | B2 * | 10/2003 | Fujiwara et al. | 101/141 |
| 6,831,670 | B2 * | 12/2004 | Fujiwara | 347/222 |

(Continued)

FOREIGN PATENT DOCUMENTS

| | | |
|---|---|---|
| EP | 0 392 643 | 10/1990 |

(Continued)

OTHER PUBLICATIONS

European Search Report for Application No. EP05256292, dated Feb. 6, 2008.

(Continued)

*Primary Examiner*—Judy Nguyen
*Assistant Examiner*—'Wyn' Q Ha
(74) *Attorney, Agent, or Firm*—Marshall, Gerstein & Borun LLP

(57) ABSTRACT

A printing device comprising a casing having a first part housing a first printing mechanism which comprises a printhead and a platen located at a print zone, and a holder for holding a roll of precut label stock in a position to pass through the print zone, and a second part housing a second printing mechanism which comprises a printhead and a platen located at a print zone and means for receiving a cassette housing image receiving tape in a position to pass through the print zone.

12 Claims, 4 Drawing Sheets

U.S. PATENT DOCUMENTS

| | | | | |
|---|---|---|---|---|
| 6,871,026 | B2 * | 3/2005 | Shimura et al. | 399/12 |
| 7,165,741 | B2 * | 1/2007 | Takagi et al. | 242/564.4 |

FOREIGN PATENT DOCUMENTS

| | | | | |
|---|---|---|---|---|
| EP | 0 641 663 | | | 3/1995 |
| EP | 0 798 122 | | | 10/1997 |
| EP | 0 834 828 | | | 4/1998 |
| EP | 0 847 863 | | | 6/1998 |
| EP | 1 084 85 | A2 | | 3/2001 |
| EP | 1 084 851 | A2 | | 3/2001 |
| JP | 59076283 | A | * | 5/1984 |
| JP | 05185674 | A | * | 7/1993 |
| JP | 06011382 | A | * | 1/1994 |
| JP | 06312524 | A | * | 11/1994 |
| JP | 07205491 | A | * | 8/1995 |
| JP | 07314808 | A | * | 12/1995 |
| JP | 10-138584 | | | 5/1998 |
| JP | 10-138595 | A | | 5/1998 |
| JP | 11-005333 | | | 1/1999 |
| JP | 11-286129 | | | 10/1999 |
| JP | 2001-270188 | A | | 10/2001 |
| JP | 2002211077 | A | * | 7/2002 |
| JP | 2002-240359 | A | | 8/2002 |
| JP | 2002-283600 | | | 10/2002 |
| JP | 2003127451 | A | * | 5/2003 |
| JP | 2003327225 | A | * | 11/2003 |
| JP | 2003341215 | A | * | 12/2003 |

OTHER PUBLICATIONS

English-language translation of Japanese Office Action for Application No. 2005-306568.

European Office Action for Application No. EP05256292.3, dated Aug. 27, 2009.

English-language translation of Japanese Office Action for Application No. 2005-306568, dated Nov. 30, 2009.

* cited by examiner

HYBRID PRINTER

RELATED APPLICATIONS

This application claims priority to U.S. Provisional Application Ser. No. 60/620,685, filed Oct. 22, 2004, the disclosure of which is incorporated herein by reference thereto.

FIELD OF THE INVENTION

This invention relates to a hybrid printer, that is, a printer having two or more printing mechanisms mounted therein.

BACKGROUND

Hybrid printers having two or more printing mechanisms are known. One type of hybrid printer has a non-impact type thermal printing mechanism and an impact type wire dot printing mechanism, with a control circuit for controlling both printing mechanisms based on data transferred from a host device such as a host computer. In this type of hybrid printer, customer receipts for example are printed on thermal paper while slip forms such as cheques and vouchers are printed using a wire dot printing mechanism.

EP-A-834828 relates to a hybrid printer of this type, where each printing mechanism can be selectively controlled from a host computer, wherein error processing is performed according to the selected printing mechanism.

One issue with hybrid printing mechanisms is the need to make such devices compact yet not compromise the printing mechanisms and quality of the output printed labels.

SUMMARY OF THE INVENTION

According to one aspect of the present invention there is provided a printing device comprising a casing having: a first part housing a first printing mechanism which comprises a printhead and a platen located at a print zone, and a holder for holding a roll of precut label stock in a position to pass through the print zone; a second part housing a second printing mechanism which comprises a printhead and a platen located at a print zone and means for receiving a cassette housing image receiving tape in a position to pass through the print zone.

In the described embodiment, the first part is fixed and the second part is movable. However, it will readily be appreciated that the first and second parts could both be movable, one relative to the other.

In the described embodiment the casing comprises an upper portion and a lower portion, the lower portion comprising a frame for supporting the upper portion, said frame and said upper portion constituting said fixed part, and the lower portion also providing said movable part.

The frame preferably defines an opening within which the movable part is slidably mounted, and the movable part can comprise a tray or drawer.

Preferably, the tray is automatically controllable by a motor connected to control its movement. It can be controlled by use of an actuator button on the printing device.

The receiving means for the first mechanism can comprise a holder for holding a roll of precut label stock, for example to perform printing in the manner of a known LabelWriter printer product for die cut labels.

The receiving means for the second printing mechanism can comprise a cassette receiving bay for receiving a cassette housing image receiving tape, and optionally an ink ribbon, for performing printing in the manner of a known tape printer such as the LabelManager 400 manufactured by Dymo.

A reverse feed actuator can be provided for reversing a supply of image receiving media.

The fixed part can include an openable lid.

The movable part can include a cutting mechanism for cutting off a portion of tape which has been printed by the second printing mechanism.

The printing device can comprise first and second sensing means in the form e.g. of a limit switch or optical sensing means for sensing respective open and closed conditions of the movable part.

According to another aspect of the invention there is provided a printing device comprising a casing having a first part and a second part movable with respect to the first part, the casing housing a first printing mechanism in the first part and a second printing mechanism in the second part, each printing mechanism comprising a printhead, a platen and means for receiving a supply of image receiving media.

Another aspect of the invention provides a printing device comprising a casing which has a frame defining an opening within which a movable part is slidably mounted, the movable part housing a printing mechanism comprising a printhead and a platen defining a print zone and a cassette receiving means for receiving a cassette housing image receiving tape positioned to pass through the print zone.

A further aspect of the invention provides a printing device comprising a casing having: a first part housing a first printing mechanism which comprises a printhead and a platen located at a print zone, and first means for receiving a supply of precut label stock in a position to pass through the print zone; and a second part housing a second printing mechanism which comprises a printhead and a platen located at a print zone and second means for receiving a supply of continuous tape disposed to pass through the print zone.

That is, the invention provides for a printing device which can print on die cut labels or continuous tape. The first and/or second receiving means can comprise cassette receiving means for receiving a cassette which holds continuous tape or die cut tape. Alternatively, one of the first and second receiving means can comprise a holder for holding a roll of precut label stock, while the other comprises a cassette receiving means.

A further aspect of the invention provides a printing device comprising a casing having: a first part housing a first printing mechanism which comprises a printhead and platen located at a print zone, and a first means for receiving a supply of image receiving medium of a first width in a position to pass through the print zone; and a second part housing a second printing mechanism which comprises a printhead and a platen located at a print zone and second means for receiving a supply of image receiving medium of a second width in a position to pass through the print zone, the first and second widths being different.

In such a printer, one print mechanism can be arranged to print labels where a relatively small print height is needed (for example less than 25 mm), and the other print mechanism is for labels where a relatively high print height is needed. The first and second receiving means can each comprise cassette receiving means for receiving cassettes respectively housing tapes of the first and second different widths. The image receiving media can be continuous tape or die cut.

BRIEF DESCRIPTION OF THE FIGURES

For a better understanding of the present invention and to show how the same may be carried into effect, reference will now be made by way of example to the accompanying drawings, in which.

DESCRIPTION OF SEVERAL EMBODIMENT(S)

Figure 1:
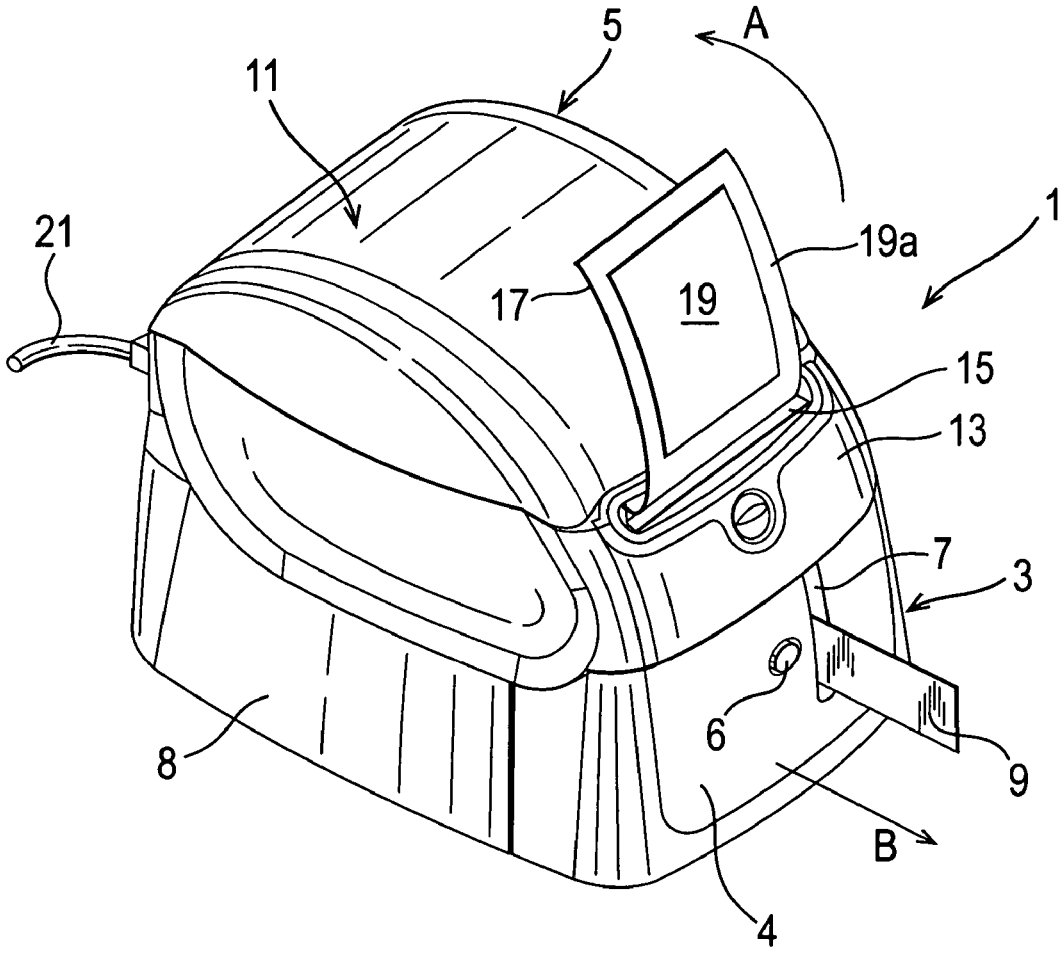
FIG. 1 is a schematic view of a printing device from the outside.

FIG. 1 illustrates a hybrid printer in accordance with one embodiment of the invention. The hybrid printer 1 comprises a lower portion 3 and an upper portion 5. The upper portion houses a first printing mechanism which is described later. The lower portion has a fixed frame 8 which supports the upper portion to constitute a fixed part of the printer 1. The lower portion also has a movable part in the form of a tray 4 which houses a second printing mechanism which is referred to herein as a tape printing mechanism and which is described more fully later. The tray 4 has an exit slot 7 for tape 9. The tape 9 comprises an image receiving layer secured to a removable backing layer via adhesive and is well known in the art. It is so-called continuous tape because the image receiving layer is continuous and is not pre-cut into labels.

The tray 4 has an actuation button 6. When the actuation button is depressed, a motor 27 is activated to slide the tray 4 forward in the direction of arrow B from a closed position to an open position to allow a cassette which holds the tape 9 to be inserted. Actuation of the same button causes the tray to revert to its original closed position. The frame 8 has an opening 29 within which the tray 4 slides.

The upper portion of the casing 5 comprises a lid 11 which can be opened in the direction of arrow A to allow access to the first printing mechanism. A front part 13 of the upper portion of the casing 5 has an exit slot 15 for die cut label stock 17. Die cut label stock comprises a sequence of labels 19 removably secured to a carrier 19*a* by an adhesive in a manner which is well known in the art. A backing carrier 19*a* acts as a web supporting a plurality of labels, like the label 19 which is illustrated in FIG. 1.

Figure 2:
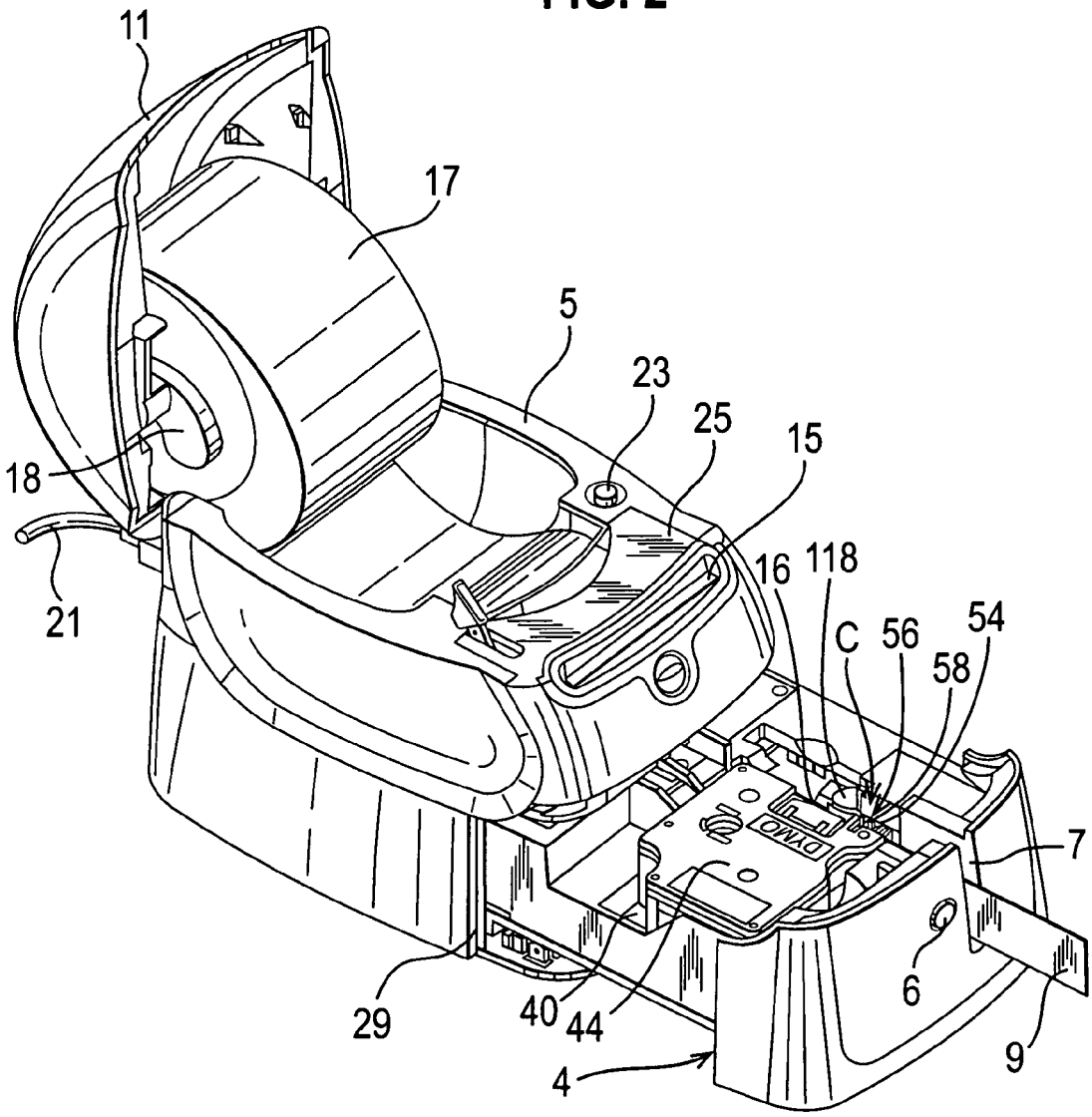
FIG. 2 is a schematic perspective view of the printing device in an open condition.

FIG. 2 shows the printing device with the drawer 4 in the open position and with the lid 5 also in the open position. This reveals in the upper portion a first printing mechanism for die cut labels and a second printing mechanism in the tray which is a tape printing mechanism.

Figure 3:
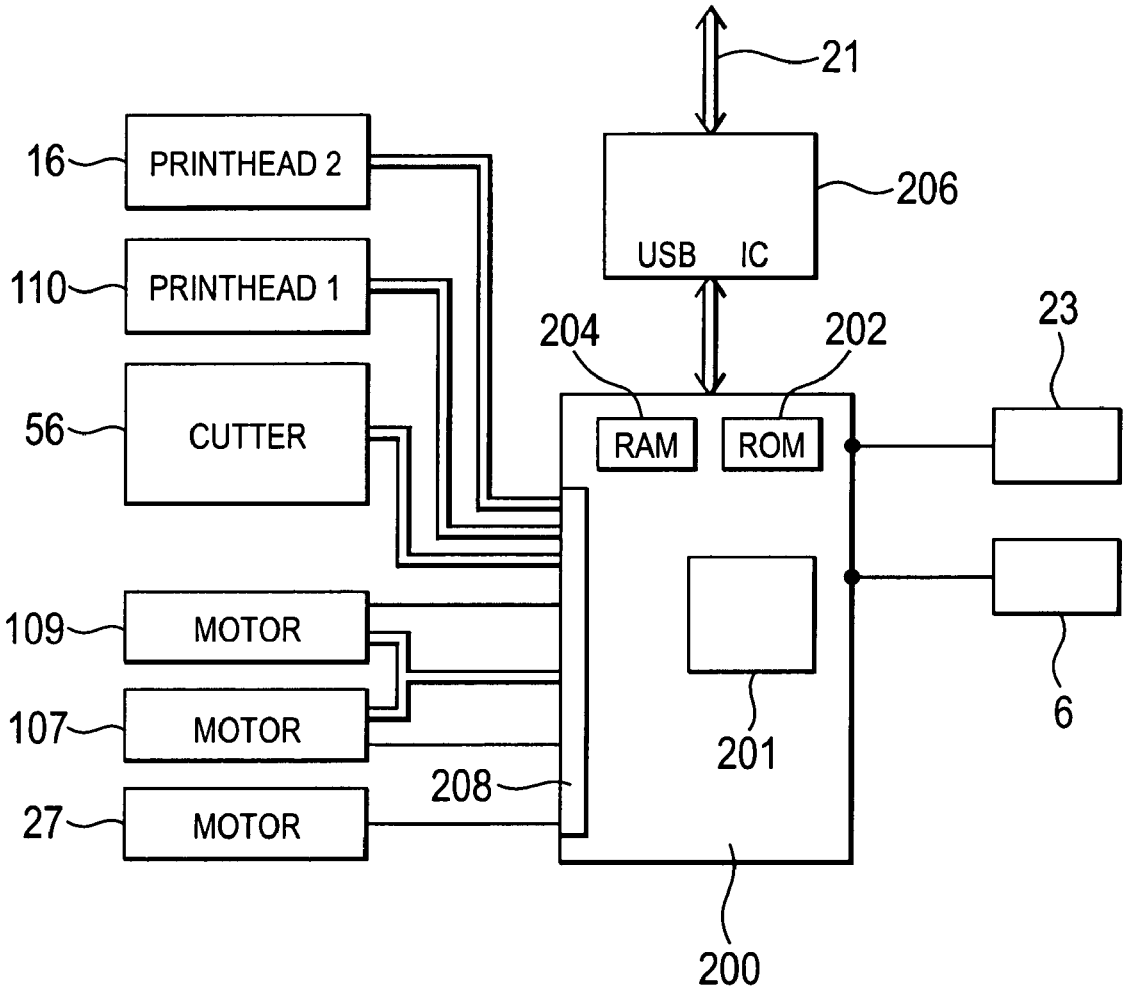
FIG. 3 is a schematic block diagram of circuitry for controlling the printing device.

As shown more clearly in FIG. 2, the upper portion 5 of the label printer accepts a roll of label stock 17. The roll of label stock 17 is mounted on a holder 18 in the lid 11. The printing mechanism includes a platen (not visible in FIG. 2) and a printhead 110 (FIG. 3). Another feature is that the visibility into the label loading area is maximised by flattening the profile in front of the label loading area, as designated by reference numeral 25. This makes it easier to load and unload rolls of label stock. A DC motor 109 (FIG. 3) drives the platen such that the platen turns in a clockwise or counter-clockwise direction. Rotation of the platen causes the label stock 17 to advance in a forward direction if the platen rotates counter-clockwise, or to advance in a reverse direction if the platen rotates clockwise. The platen can be rotated to reverse the label stock under the control of a reverse feed button 23.

A problem in existing printers is that it is not easy to remove a spool of labels. The user has to release the label with a manual release lever and at the same time the spool of labels has to be manually rewound. The reverse feed button 23 acts as a label stop eject button which solves this problem by reverse feeding the spool of labels for a predetermined amount of time by controlling the motor 109. A simple press on the reverse feed (label stop eject) button 23 reverse feeds the spool of labels and the spool of labels is ready to take out of the printer.

The printhead 110 prints information onto the labels 19 of the label stock 17. The printhead 110 is positioned such that information is printed at a pinch point of the platen and printhead 110. The printhead is a 300 dpi printhead with a print width of 57 mm and a total of 672 heating elements or dots.

In the lower portion of the printer, the tray 4 provides a cassette receiving bay 40 for receiving a cassette 44 for the second printing mechanism.

The cassette bay 40 includes a thermal printhead 16 and a platen 118 which cooperate to define a print zone. The thermal printhead 16 has 96 dots and is 13.5 mm in height. It could alternatively be 128 dots on 18 mm. It has a print density of 180 dpi.

The printhead 16 is pivotable about a pivot point so that it can be brought into contact with the platen 18 for printing and moved away from the platen 18 to enable the cassette to be removed and replaced. The cassette 44 holds a supply spool of image receiving tape 9. The image receiving tape 9 is guided by a guide mechanism (which is not shown) through the cassette 44, out of the cassette 44 through an outlet past the print zone to a cutting location C. The same cassette 44 also has an ink ribbon supply spool and an ink ribbon take-up spool. The ink ribbon is guided from the ink ribbon supply spool through the print zone and taken up on the ink ribbon take-up spool. The image receiving tape 9 passes in overlap with the ink ribbon through the print zone with its image receiving layer in contact with the ink ribbon. The platen is driven by a stepper motor 7 (FIG. 3). The motor rotates to drive the image receiving tape through the print zone 3 continuously during printing.

An image is printed on the tape fed out from the print zone to the cutting location C which is provided at a location in a portion of the wall of the cassette 44 which is close to the print zone. A slot 54 is defined in the wall portion and the image receiving tape 9 is fed past the print zone to the cutting location C where it is supported by facing wall portions on either side of the slot 54.

A cutting mechanism 56 includes a cutter support member 58 which carries a blade. The blade cuts the image receiving tape 9 and then enters the slot 54.

The ink ribbon can be omitted in certain embodiments where the image receiving tape is of a thermally sensitive material. In this case, the image is printed by the thermal print head directly onto the thermally sensitive image receiving tape.

Although not visible in the figure, the cassette bay has a slide switch which cooperates with a slot on the lower face of the cassette. With the switch in a first position, a cassette having a slot in a corresponding position can be inserted into the cassette bay, but a cassette having a slot in a different position cannot be. This allows a user to ensure that only cassettes housing tape of a designated width can be inserted into the cassette bay.

FIG. 3 illustrates basic circuitry for controlling the printing device. This circuitry is implemented on a PCB in the lower part of the casing, and so cannot be seen in FIGS. 1 and 2. A microprocessor chip 200 provides read only memory ROM 202, random access memory RAM 204 and a microprocessor 201. In addition, the microprocessor chip 200 has a plurality of ports 208 for connection to various peripheral devices as described more particularly in the following. The microprocessor chip 200 is connected to receive print data which is incoming from a USB chip 206 which connects the printing device to a host computer via the bidirectional link 21. The chip 200 can also output information, such as status information to the host computer via the USB chip 206. The microprocessor chip 200 also controls both of the printheads 16, 110 from separate ports. On receipt of print data from the host computer, it is ascertained by the local processor which printhead is to be driven in the printing device, and the print data is supplied to that printhead accordingly.

The printhead 110 of the first printing mechanism receives print data for driving the heating elements or dots to print information on the labels 19 on a column by column basis as the label stock is advanced past the printing mechanism.

The chip 200 also controls the stepper motors 107, 109 which respectively drive the platens which feed the roll of label stock 17 and tape 9 respectively in the respective printing mechanisms. The signal for the stepper motors is provided from a common port, with the number of pins of that port being shared in common, and with a separate pin being supplied to enable each stepper motor. It will be appreciated that the stepper motors are not enabled together. The microprocessor 202 also controls the cutting mechanism 58.

The above-described embodiment is particularly useful where the second printing mechanism is used for printing small labels (for example labels printed with a print height up to 25 mm), and the first printing mechanism is used for printing large labels (for example labels with a print height larger than 25 mm).

Figure 4:
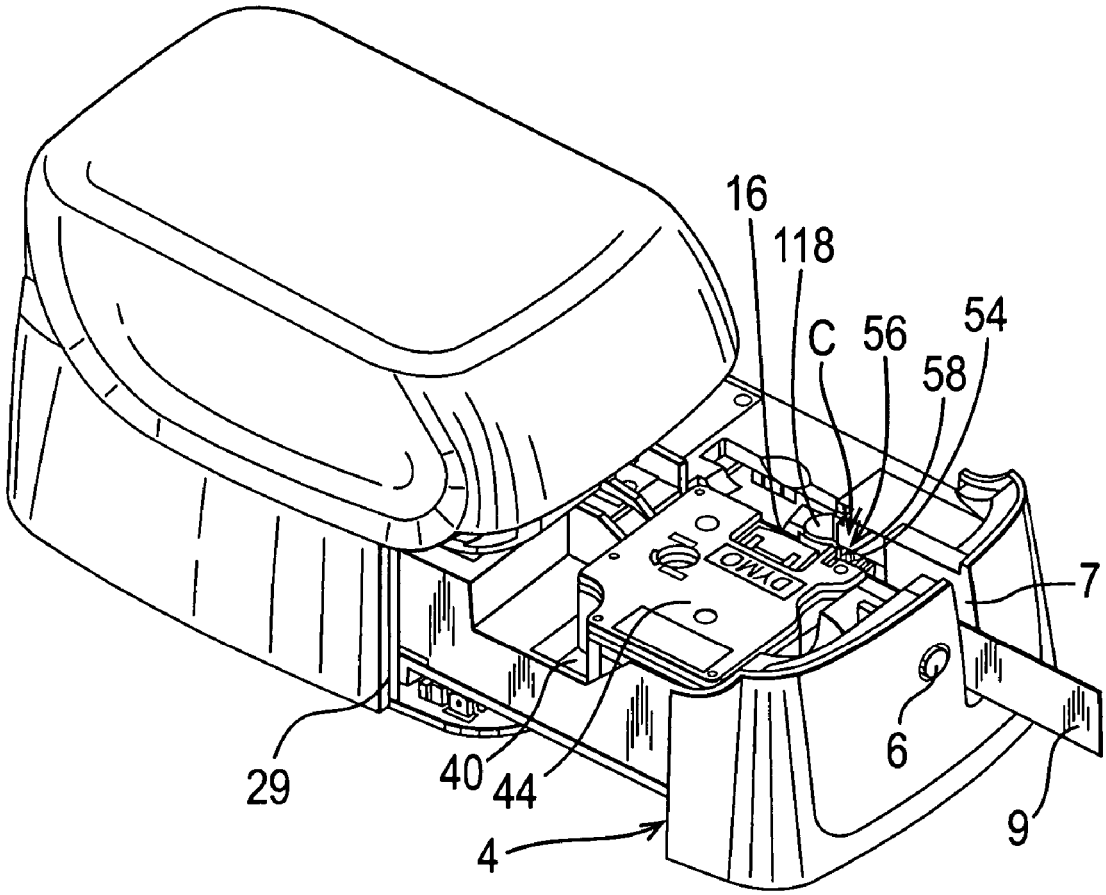
FIG. 4 is a schematic view of a printing device in accordance with another embodiment of the invention.

FIG. 4 illustrates a different embodiment of the invention in which a fixed part of a printing device supports a movable part in the form of tray 4. Like numerals are used to denote like parts as in FIG. 2, and all aspects of FIG. 4 are the same, apart from the fact that there is no additional printing mechanism incorporated in the upper part of the casing. This provides a compact tape printer.

The invention claimed is:

1. A printing device comprising a casing having: a first part housing a first printing mechanism which comprises a first printhead and a first platen located at a first print zone, and a holder for holding a roll of precut label stock in a position to pass said label stock through the first print zone; and a second part housing a second printing mechanism which comprises a second printhead and a second platen located at a second print zone and a cassette bay configured to receive a cassette housing a supply of image receiving tape in a position to pass said image receiving tape through the second print zone, wherein one of the first part or the second part at least partially overlays the other of the first part or the second part, and wherein said holder for holding a roll of precut label stock and said cassette bay are configured such that in use an axis of rotation of said roll of precut label stock is substantially perpendicular to an axis of rotation of said supply of image receiving tape, and wherein the second part comprises a cutting mechanism for cutting off a portion of tape which has been printed by the second printing mechanism.

2. A printing device according to claim 1, wherein the first part is located above the second part.

3. A printing device according to claim 1, wherein the easing comprises an upper portion and a lower portion, the lower portion comprising a frame for supporting the upper portion, said frame and said upper portion constituting said first part, and the lower portion also providing said second part.

4. A printing device according to claim 3, wherein the frame defines an opening within which the second part is slidably mounted.

5. A printing device according to claim 1, wherein the first part includes an openable lid.

6. A printing device according to claim 1 wherein the second part is moveable with respect to the first part, said device further comprising a motor connected to control movement of the second part.

7. A printing device according to claim 6, wherein the first part is fixed and the second part is movable.

8. A printing device according to claim 6, wherein the second part is movable under the control of an actuator button on the printing device.

9. A printing device according to claim 6, which comprises a first limit sensor for sensing an open condition of the second part.

10. A printing device according to claim 9, which comprises a second limit sensor configured to sense a closed condition of the second part.

11. A printing device comprising a casing having: a first part housing a first printing mechanism which comprises a first printhead and a first platen located at a first print zone, and a holder for holding a roll of precut label stock in a position to pass said label stock through the first print zone; and a second part housing a second printing mechanism which comprises a second printhead and a second platen located at a second print zone and a cassette bay configured to receive a cassette housing a supply of image receiving tape in a position to pass said image receiving tape through the second print zone, said casing comprising an upper portion and a lower portion, the lower portion comprising a frame for supporting the upper portion, said frame and said upper portion constituting said first part, and the lower portion also providing said second part, wherein the frame defines an opening within which the second part is slidably mounted, said second part comprising a tray, and wherein said holder for holding a roll of precut label stock and said cassette bay are configured such that in use an axis of rotation of said roll of precut label stock is substantially perpendicular to an axis of rotation of said supply of image receiving tape.

12. A printing device according to claim 11, said device further comprising a motor connected to control movement of the second part.

* * * * *